US011225274B2

(12) United States Patent
Burger

(10) Patent No.: US 11,225,274 B2
(45) Date of Patent: Jan. 18, 2022

(54) DEVICE FOR MOVING A GUIDE TRACK SECTION OF A GUIDE TRACK SYSTEM FOR VEHICLES ON A FUN FAIR RIDE

(71) Applicant: Mack Rides GmbH & Co. KG, Waldkirch (DE)

(72) Inventor: Gunter Burger, Waldkirch (DE)

(73) Assignee: Mack Rides GmbH & Co. KG, Waldkirch (DE)

( * ) Notice: Subject to any disclaimer, the term of this patent is extended or adjusted under 35 U.S.C. 154(b) by 388 days.

(21) Appl. No.: 16/302,922

(22) PCT Filed: May 9, 2017

(86) PCT No.: PCT/EP2017/061082
§ 371 (c)(1),
(2) Date: Nov. 19, 2018

(87) PCT Pub. No.: WO2017/198501
PCT Pub. Date: Nov. 23, 2017

(65) Prior Publication Data

US 2019/0161099 A1 May 30, 2019

(30) Foreign Application Priority Data

May 20, 2016 (DE) ..... 10 2016 109 373.4

(51) Int. Cl.
*B61J 1/08* (2006.01)
*A63G 21/14* (2006.01)
(Continued)

(52) U.S. Cl.
CPC ..... *B61J 1/08* (2013.01); *A63G 7/00* (2013.01); *A63G 21/04* (2013.01); *A63G 21/14* (2013.01)

(58) Field of Classification Search
CPC ..... A63G 7/00; A63G 21/04; A63G 21/14; A63G 31/00; A63G 31/02; A63G 31/10; B61J 1/08; B61J 1/10
See application file for complete search history.

(56) References Cited

U.S. PATENT DOCUMENTS 6,941,872 B2 * 9/2005 Roodenburg ..... A63G 7/00 104/53
7,484,460 B2 * 2/2009 Blum ..... A63G 7/00 104/53
(Continued)

FOREIGN PATENT DOCUMENTS

CA 2931103 8/2018
CN 202185151 4/2012
(Continued)

OTHER PUBLICATIONS

Japan Patent Office, "Office Action" and English translation thereof, issued in Japanese Patent Application 2018-560966, dated Nov. 12, 2019, document of 12 pages.
(Continued)

*Primary Examiner* — Robert J McCarry, Jr.
(74) *Attorney, Agent, or Firm* — Akerman LLP; Peter A. Chiabotti

(57) ABSTRACT

The present application relates to a device for moving back and forth a guide track section of a guide track system for vehicles of a fun fair ride from a first guide track connection part to a second guide track connection part which is arranged at a distance from the first guide track connection part, wherein the first and the second guide track connection parts are part of the guide track system, comprising a guide track section onto which at least one of the vehicles can travel, a carrier structure for carrying the guide track section, a guide structure which has an active connection with the carrier construction and with which the carrier structure can
(Continued)

be guided in such a manner that the guide track section can be moved back and forth from the first guide track connection part to the second guide track connection part along the guide structure, and a drive device for moving the carrier structure along the guide structure, wherein the carrier structure comprises means for making another movement of the guide track section in addition to the movement along the guide structure.

20 Claims, 4 Drawing Sheets

(51) Int. Cl.
*A63G 7/00* (2006.01)
*A63G 21/04* (2006.01)

(56) References Cited

U.S. PATENT DOCUMENTS

| | | | | |
|---|---|---|---|---|
| 8,943,975 | B2 | 2/2015 | Gmeinwieser et al. | |
| 9,084,941 | B1 * | 7/2015 | Fram | A63G 31/16 |
| 2005/0098056 | A1 | 5/2005 | Roodenburg et al. | |
| 2007/0074638 | A1 | 4/2007 | Blum et al. | |
| 2012/0258812 | A1 | 10/2012 | Osterman et al. | |
| 2013/0019771 | A1 | 1/2013 | Gmeinwieser et al. | |
| 2016/0243451 | A1 | 8/2016 | Burger | |
| 2016/0288809 | A1 | 10/2016 | Sornik et al. | |

FOREIGN PATENT DOCUMENTS

| | | | | |
|---|---|---|---|---|
| CN | 203540039 | | 4/2014 | |
| CN | 103505878 | | 6/2015 | |
| CN | 204601603 | | 9/2015 | |
| CN | 105251208 | | 1/2016 | |
| DE | 10135365 | | 1/2003 | |
| DE | 10135365 | A1 * | 1/2003 | A63G 7/00 |
| DE | 10135368 | | 1/2003 | |
| DE | 20316695 | | 4/2005 | |
| DE | 60302942 | | 7/2006 | |
| DE | 102014101007 | | 3/2015 | |
| DE | 102013222910 | | 5/2015 | |
| EP | 1378277 | | 1/2004 | |
| EP | 1757348 | | 8/2005 | |
| JP | 2001120842 | | 5/2001 | |
| WO | 2015113657 | | 8/2015 | |

OTHER PUBLICATIONS

German Patent and Trademark Office ; "German Office Action", issued in German Patent Application No. 102016109373.4, dated Feb. 9, 2017; document of 5 pages.

World Intellectual Propert Organization, "International Search Report", and English translation thereof, issued in International Application No. PCT/EP2017/061082, dated Aug. 11, 2017, document of 6 pages.

European Patent Office, "Office Action" issue in European patent application No. 17 728 067.4, dated Apr. 21, 2020; document of 5 pages.

Tthe State Intellectual Property Office of People's Republic of China, "The First Office Action" and English translation thereof, issued in Chinese Patent Application No. 201780031014.1, dated Sep. 5, 2019, document of 16 pages.

* cited by examiner

DEVICE FOR MOVING A GUIDE TRACK SECTION OF A GUIDE TRACK SYSTEM FOR VEHICLES ON A FUN FAIR RIDE

CROSS REFERENCE TO RELATED APPLICATIONS

This application is a § 371 National Phase of PCT/EP2017/061082, filed May 9, 2017, the entirety of which is incorporated by reference and which claims priority to German Patent Application No. 10 2016 109 373.4, filed May 20, 2016.

BACKGROUND

The present application relates to a device for moving back and forth a guide track section of a guide track system for vehicles of a fun fair ride from a first guide track connection part to a second guide track connection part which is arranged at a distance from the first guide track connection part, wherein the first and the second guide track connection parts are part of the guide track system.

SUMMARY

Fun fair rides are a fixed part of fairs or amusement parks. In particular roller coasters, which comprises a guide track system which has elevations, drops and loops and through which a number of vehicles travel, in part at very high speeds, are especially popular.

DE 101 35 365 A1 shows a guide track section of a roller coaster which can be rotated between two inclined guide track connection parts about a fixed, substantially horizontally running axis of rotation. In a first position, the guide track section is positioned in such a manner that it is aligned with the first guide track connection part so that a vehicle that receives the passengers can ride up onto the rotatable guide track section above the first guide track connection part and stops on it. Subsequently, the guide track section is rotated about the axis until the guide track section is aligned with the second guide track connection part. Subsequently, the vehicle is again put in motion and continues its travel.

The attractiveness of such a fun fair ride depends, among other things, also on which surprising movements the vehicles can make when traveling through the guide track system. Consequently, the application has the problem of further developing a fun fair ride of the initially described type with relatively simple means in such a manner that the vehicle can make a surprising and not foreseeable movement.

This problem is solved with the features and structures recited herein. Advantageous embodiments are further disclosed herein.

An embodiment of the disclosure relates to a device for moving back and forth a guide track section of a guide track system for vehicles of a fun fair ride from a first guide track connection part to a second guide track connection part arranged at a distance from the first guide track connection part, wherein the first and the second guide track connection parts are part of the guide track system, comprising a guide track section onto which at least one of the vehicles can travel, a carrier structure for carrying the guide track section, a guide structure which has an active connection with the carrier construction and with which the carrier structure can be guided in such a manner that the guide track section can be moved back and forth from the first guide track connection part to the second guide track connection part along the guide structure, and comprises a drive device for moving the carrier structure along the guide structure, wherein the carrier structure comprises means for making another movement of the guide track section in addition to the movement along the guide structure. It is mentioned at this point that the guide track section does not have to be moved directly between the first and the second guide track connection. Rather, the second guide track connection part can be passed at first before a reversal of the direction of movement takes place in order to arrive then at the second guide track connection part. In addition, not only a first and a second guide track connection part can be provided but rather several of them. In addition, it should be made clear that the means can be designed in such a manner that it can make a single further movement or several further movements depending on which movement pattern should be generated. According to this embodiment of the disclosure, a vehicle can be moved back and forth with any movement from a first to a second guide track connection part. During this time, as already initially explained, the vehicle is moved via the guide track connection part of the guide track system onto the movable guide track section, stopped there and moved together with the guide track section in such a manner to the second or another guide track connection part that the vehicle can subsequently continue its travel, wherein the means makes it possible to impose another movement on the guide track section in addition to the movement along the guide structure.

Therefore, it is not only possible, as is shown in DE 101 35 365 A1, to rotate the guide track section together with the vehicle about a stationary axis running approximately horizontally but rather, for example, to combine a rotating movement with a translatory movement. It is also possible to rotate the guide track section in the vehicle about a substantially vertically running axis. A significant aspect here is the fact that the means to be used to this end is designed in such a manner that the further movement is carried out additionally to the movement along the guide structure, that is, independently of the shape of the guide structure. There is a difference here from WO 1 2015/113657A1 in which the guide track section also makes a rotary as well as a superposed translatory movement; however, here the guide track stipulates the movement of the guide section, which has the result that the translatory movement runs parallel to the axis of rotation. Consequently, an elevated degree of freedom in the superposed movements is made available with the present disclosure. The guide track section and consequently the vehicle can be moved with a plurality of movements which can also be superposed on each other between two or more guide track connection parts. The attractiveness of the fun fair ride is distinctly increased as a result in comparison to known fun fair rides.

In an alternative embodiment the carrier structure can comprise a first section connected to the guide structure and comprises a second section connected to the guide track section, wherein the second section can be moved relative to the first section. In this embodiment it is possible that the guide track section and the vehicle fixed on it can make other movements relative to the guide structure. For example, the guide track section can be rotated about one or more axes of rotation while it is moved translatorily along the guide structure between the guide track connection parts. In particular, a back-and-forth movement or a rocking movement can be realized, which further increases the traveling pleasure.

An embodiment is distinguished in that the embodiment comprises another drive device for making available the movement of the first section relative to the second section. In general, it is possible to allow a movement of the guide track section even without a drive device which develops, for example, due to the inertia of the vehicle during the delay on the guide track section or by the shiftings of the weight of the passengers. However, a purposeful movement of the two sections relative to one another can be set with the other dive device, for example, a somersault, which could not be realized solely by the inertia of the vehicle or the shifting weight of the passengers. In addition, the other drive device can be controlled in such a manner that other movements can be set again and again so that the alternation and the surprise effect remain preserved.

In another embodiment the device comprises a limiting unit for limiting the movement of the guide track section. A limiting of the movement is advantageous if the movement should not be too extreme for the passengers. For example, it can be prevented by stops or damping elements that the guide track section in the vehicle execute a somersault. In particular, the using of damping elements can gradually brake a certain movement so that no suddenly stopping movements take place which usually represent a high degree of stress on the human body.

In another embodiment the guide track section can comprise a fixing device for fixing the vehicle on the guide track section. According to which movements are executed by the guide track section when it moves between the first guide track connection part and the second or the other guide track section parts, the vehicle can be put in motion on the guide track section and even be disconnected from the guide track section. Such a disconnection must be prevented under all circumstances, for which reason the vehicle can be held by the fixing device in a certain position on the guide track section independently of which movement the guide track section makes between the two guide track section parts. This distinctly increases the safety of the fun fair ride and in addition even complex movements such as somersaults can be made. The fixing device can comprise catch means and/or wedges which anchor the vehicle on the guide track section and which can be detached from the vehicle again upon reaching the second guide track connection part. Other possibilities are brakes or stops which can limit free movement of the vehicle on the guide track section.

Another embodiment of the application relates to a device, in particular according to the present disclosure, for moving a guide track section of a guide track system for vehicles of a fun fair ride between two or more guide track connection parts of the guide track system, which parts are arranged at a distance from each other, which device comprises a guide track section onto which at least one of the vehicles can be driven, a guide structure which has an active connection with the carrier structure, and with which the carrier structure is guided in such a manner that the guide track section can be moved back and forth from the first guide track connection part to the second guide track connection part along the guide structure, and comprises a drive device for moving the carrier structure along the guide structure, wherein the drive device acts in such a manner on the carrier structure that the movement along the guide structure is already made when the vehicle is still moving on the guide track section. Roller coasters are known which have an elevator with which the vehicles are raised or lowered between two vertically offset guide track connection parts, for example, from JP 2001 120 842 A. Here the vehicle is first driven onto the guide track section, stopped there and anchored with the guide track section and/or fixed to it before the vehicle is raised or lowered with the guide track section. As a consequence, the travel is interrupted until the vehicle is anchored. In contrast to this, in this embodiment the guide track section has already been made along the guide structure as soon as the vehicle is completely located on the guide track section and is still moving on the guide track section. For the case that the fixing of the vehicle on the guide track section should be necessary, the fixing can be carried out later when the guide track structure together with the carrier structure is already being moved along the guide structure. Consequently, the vehicle is never at a standstill, so that the one movement seamlessly merges into another movement and in particular the movements can be superimposed. This can create special riding experiences.

In an alternative embodiment at least two of the guide track sections can be arranged in a vertically offset manner and the carrier structure can be guided in such a manner by the guide structure that the guide track section can be moved back and forth from the first guide track connection part to the vertically offset second guide track connection part. The expression vertically offset guide track connection parts should denote guide track connection parts which are arranged at different heights. In this embodiment, for example, a free fall can be realized where the vehicle together with the guide track section, starting from the higher, first guide track connection part, is exposed for a certain time to the acceleration of the force of weight without engaging in a delaying or braking manner. Shortly before reaching the second guide track connection part a delay is introduced and the guide track section is aligned in such a manner that it is aligned with the second guide track connection part and the vehicle can continue traveling over the second guide track connection part. It is exactly just as possible to continue the free fall so long that the guide track section passes the second guide track connection part and is located underneath the second guide track connection part and is only then braked. After the guide track section has been braked, the guide track section can be raised with the drive device back to the level of the second guide track connection part so that the vehicle can continue its travel. This can achieve a very attractive enjoyment of the ride. Of course, not only two guide track connection parts can be provided but rather several, so that, for example, a longer and a shorter free fall can be realized.

According to another embodiment, the guide track connection parts are arranged inclined relative to each other. This also allows the enjoyment of the ride to be increased. If, for example, the first guide track connection part, viewed in the direction of travel, is inclined upward, it is more difficult for the passenger to estimate the further course of the travel than is the case with a horizontal course.

Another embodiment is distinguished in that the guide structure is inclined relative to the vertical. In order to be able to realize a freefall in the strict sense, the guide track must follow the acting direction of the force of gravity, that is, it must run vertically or upright. If the guide structure is inclined opposite the vertical, no freefall can be realized but a flight similar to when making a ski jump can be simulated.

In this connection there is an embodiment in which the guide structure is curved or arched and is not designed to be straight. This makes it possible to vary the inclination of the guide structure, for example, in that it is rather heavily inclined opposite the vertical, starting from the first guide track connection part, but then approaches the vertical more and more as is also the case during a jump from a ski jump platform. As a consequence, other movement patterns that further increase the enjoyment of the ride can be realized with the curved or arched guide structure.

In another embodiment the guide track system is constructed as a rail system. The guide track system can also comprise, for example, troughs or pipes, which is especially advantageous if the fun fair ride comprises a lake landscape with waterfalls. In this case the vehicles can be designed as boats and are driven by the water flowing through the troughs and pipes. However, relatively narrow boundaries are set here on the speed of the vehicle and the movements which the vehicle can make. However, if a rail system is used, the vehicle can be guided in such a manner that it can reach high speeds and make a plurality of movements which also comprise somersaults.

In another embodiment the guide structure can be arranged on a tower or form a tower itself. It is absolutely customary to integrate roller coasters in existing buildings so that the buildings, in as far as they comprises a suitable tower, form a part of the guide structure. Consequently, no separate tower has to be made available, as a result of which the cost of the fun fair ride can be reduced. Alternatively, however, the guide structure can form a tower itself, which is especially appropriate when the fun fair ride is a so-called flying construction which is set up at various fairs for a certain time. The carrier structure can be designed here in such a manner that it can be readily and reliably assembled and disassembled again. This keeps the time low which is needed to assemble and disassemble the fun fair ride.

Another embodiment of the disclosure relates to a guide track system for vehicles of a fun fair ride, comprising a device according to one of the previously discussed embodiments. The technical effects and advantages which can be achieved with the suggested vehicle correspond to those which were discussed for the suggested drive device. In sum, it is pointed out that it is possible with relatively simple technical means to generate even complex movements of the guide track section and of the vehicle located on the latter so that the attractiveness of the fun fair ride can be increased with a representable expense.

Moreover, an embodiment of the disclosure relates to a fun fair ride with the guide track system according to the previously presented embodiment. The advantages and technical effects correspond to those which were presented for the guide track system and the device.

BRIEF DESCRIPTION OF THE DRAWINGS

An exemplary embodiment of the application is explained in detail in the following with reference made to the attached drawings. In the drawings

DETAILED DESCRIPTION

Figure 1:
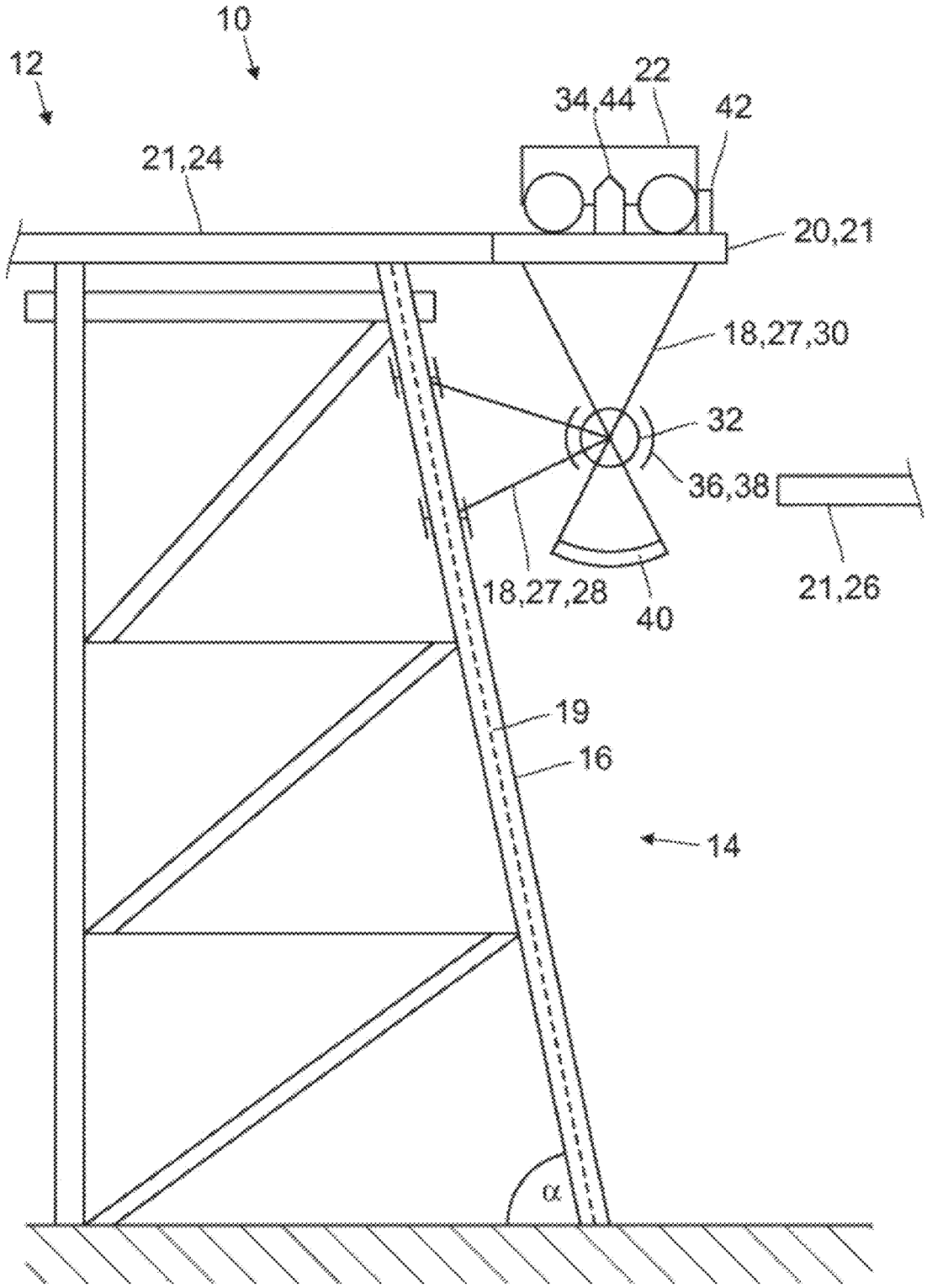
FIG. 1 shows a first exemplary embodiment of the device according to the disclosure in a first position.

FIG. 1 shows an exemplary embodiment of a device 10 according to the disclosure using a basic representation. The device 10 comprises a guide structure 12 which is designed in the exemplary embodiment shown as a skeletal tower 14 and comprises a guide rail 16. The guide rail 16 is inclined by the angle $\alpha$ relative to the horizontal (and therefore also by the angle of 90°- $\alpha$ relative to the vertical) and is approximately 75° in the example shown. Of course, it is also possible to align the guide rail 16 substantially vertically.

A carrier structure 18 can be moved by a drive device 19 along the guide rail 16. The drive device can comprise not-shown motors, actuators, spring-loaded brakes, traction cables and the like. In addition, the carrier structure 18 is connected to a guide track section 20 of the guide track system 21 on which one or more vehicles 22 can be moved. The guide track system 21 can be designed, for example, like a rail system with which the vehicles 22 are held on the desired guide track. In the example shown, the guide track system 21 comprises a first guide track connection part 24 and a second guide track connection part 26, wherein the first guide track connection part 24 is fastened at the upper end of the guide structure 12 or of the tower 14 and the second guide track connection part 26 is supported in a manner not shown in detail. Jacketed uprights (not shown) can be used to store the second guide track connection part 26. Other guide track connection parts can be provided. The first and the second guide track connection parts 24, 26 are arranged offset from one another in a vertical device by the height difference $\Delta H$ (see FIG. 2). The carrier structure 18 comprises means 27 with which the guide track section 20 can make another movement in addition to the movement along the guide rail 16. In the example shown, the means 27 comprises a first section 28 and a second section 30, wherein the carrier structure 18 is fastened to the first section 28 on the guide structure 12 and to the second section 30 with the guide track section 20. The first section 28 and the second section 30 are supported in a movable manner relative to one another so that they can make, for example, a rotation about a first axis of rotation D1 and/or about a second axis of rotation D2 relative to one another, for which, for example, ball and socket joints which are not shown here can be used. In order to make the movement available, the device 10 comprises another drive device 32. Furthermore, the device 10 comprises a fixing device 34 with which the vehicle 22 can be fixed on the guide track section 20 in the desired position. Furthermore, the device 10 comprises a limiting unit 36 with which the movement of the first section 28 of the carrier structure 18 can be limited relative to the second section 30 of the carrier structure 18, wherein the limiting unit 36 can comprise, for example, one or more stops 38. Furthermore, the second section 30 of the carrier structure 18 can comprise a counterweight 40 arranged on the side of the axes of rotation D1, D2 opposite the guide track section 20 in order to make the rotation of the first section 28 about the second section 30 more controllable.

The device 10 according to the disclosure is operated in the following manner: In FIG. 1 the carrier structure 18 is arranged by the drive device 19 in such a manner regarding the guide structure 12 that the guide track section 20 is aligned with the first guide track connection part 24. Consequently, one or more of the vehicles 22 located on the guide track system 21 can travel from the first guide track connection part 24 onto the guide track section 20. Starting from the first guide track connection part 24, the guide track system 21 is interrupted at the end of the guide track section 20 so that the vehicle 22 leaves the guide track system 21 if it would travel beyond the guide track section 20. In order to prevent this, a limiting stop 42 can be extended against which the vehicle 22 strikes when it has reached the desired position on the guide track section 20. The vehicle 22 can comprise a braking device, which is not shown, in order to be able to be stopped in the desired position.

In order to fix the vehicle 22 in the desired position on the guide track section 20, the fixing device 34 is now actuated, for example, in that a wedge 44, starting from the guide track section 20, is introduced into a receptacle of the vehicle, which receptacle is not shown in detail, with which the vehicle 22 is anchored with the guide track section 20. Subsequently or during the fixing, the carrier structure 18 is moved by a corresponding actuation of the drive device 19 along the guide structure 12 or the guide rail 16, in this case approximately vertically downward. The actuation of the drive device 19 can also include the case that the carrier structure 18 is exposed unbraked to the force of weight in order to be moved along the guide structure 12 (approximately a freefall).

Furthermore, the other drive device 19 is actuated so that the second section 30 of the carrier structure 18 is moved relative to the first section 28 and in particular is rotated. Consequently, the linear movement along the guide structure 12 is superposed by a rotary movement about the first and/or the second axis of rotation D1, D2. The movements along the guide structure 12 and about the first and/or the second axes of rotation D1, D2 are continued until the travel of the vehicle 22 along the guide track system 21 should be continued. To this end, the carrier structure 18 is positioned by the drive device 32 and the other drive device 19 in such a manner that the guide track section 20 is aligned with the second guide track connection part 26 (see FIG. 2). The guide track section can also be located here temporarily below the second guide track connection part 26, as FIG. 3 shows. The wedge 44 is moved in by an appropriate actuation of the fixing device 34, which cancels the anchoring of the vehicle 22 on the guide track section 20 and the limiting stop 42 is moved in. The vehicle can now continue traveling along the guide track system 21.

Figure 2:
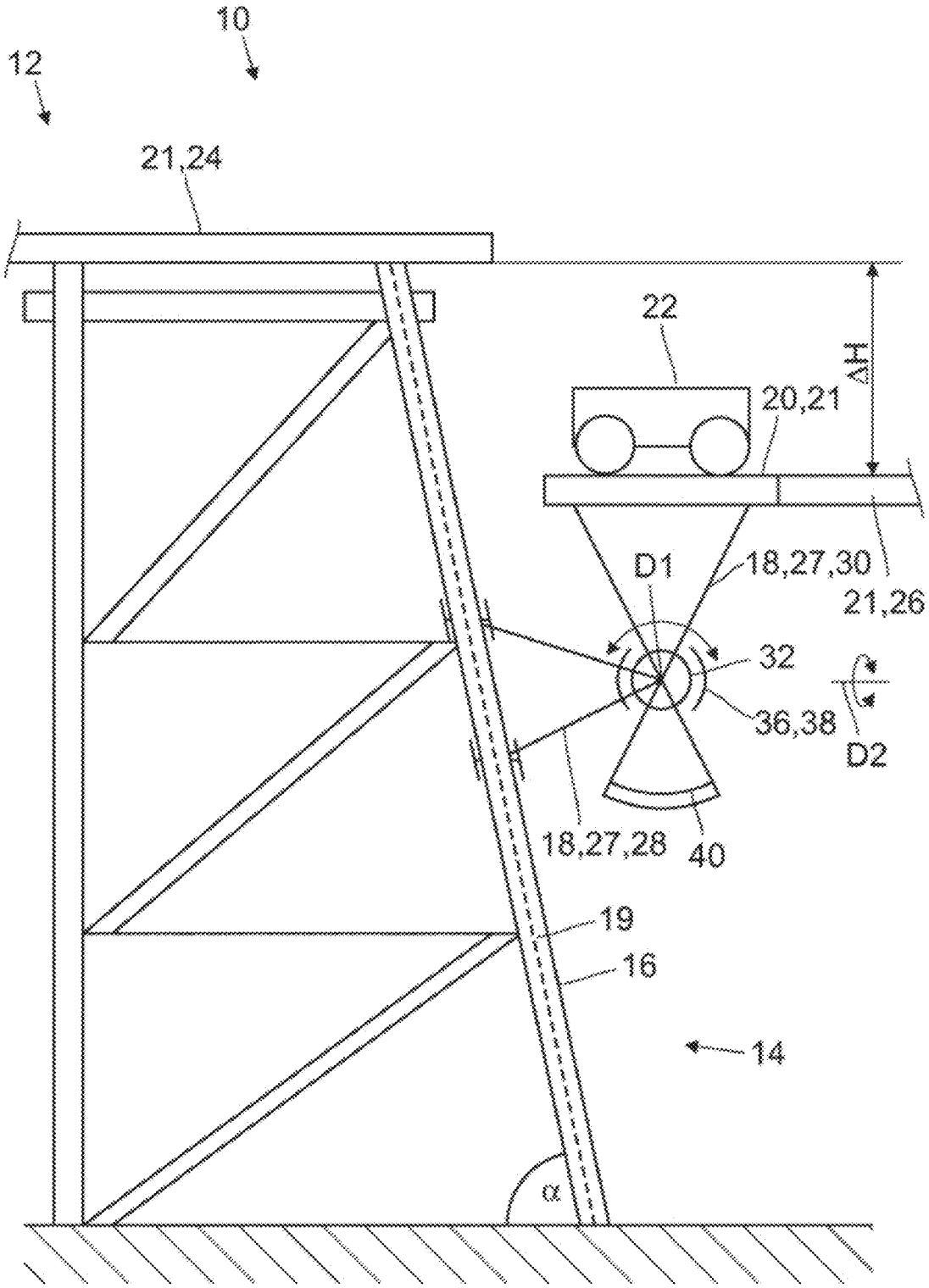
FIG. 2 shows the exemplary embodiment shown in FIG. 1 in a second position.
Figure 3:
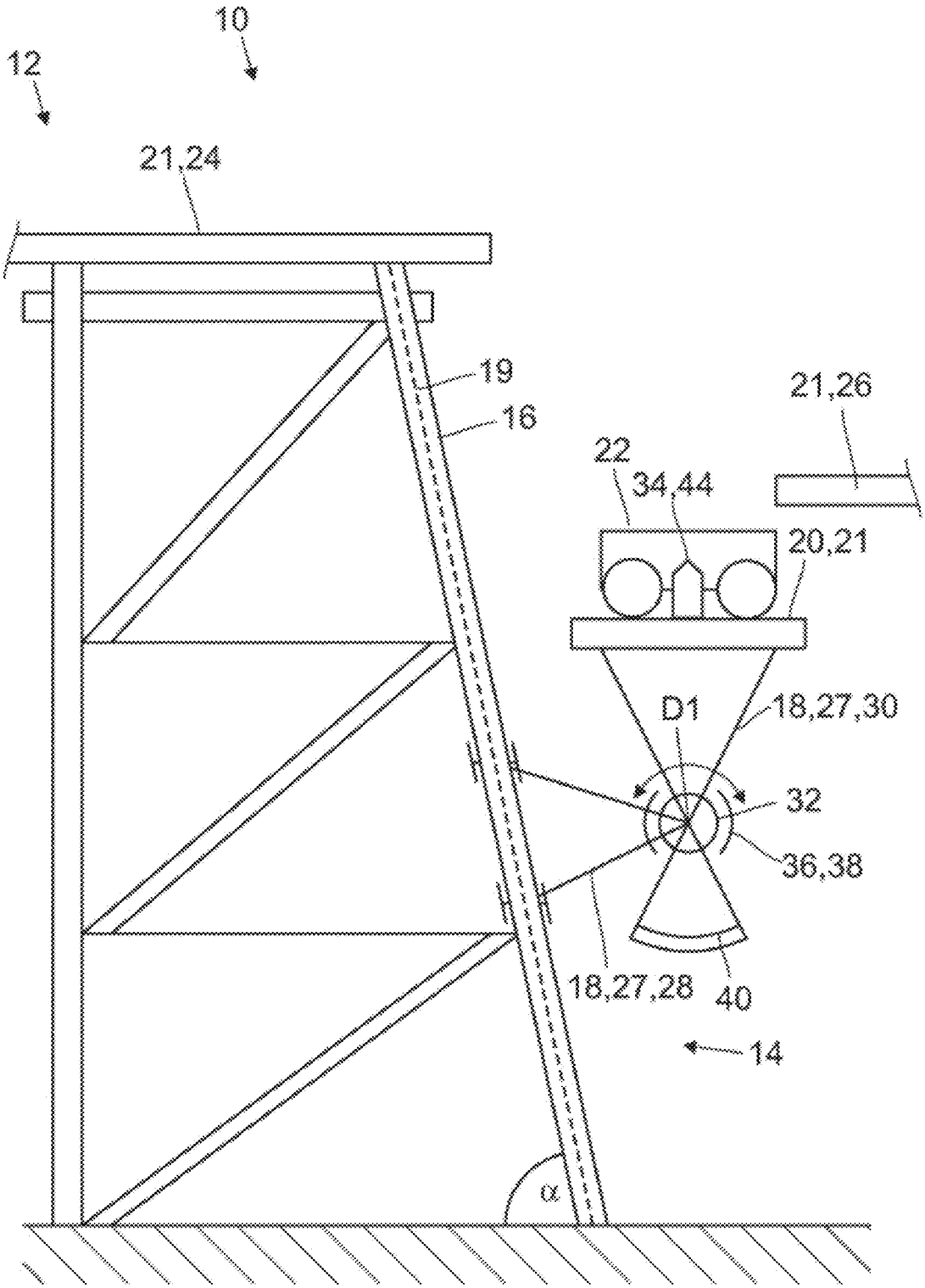
FIG. 3 shows the exemplary embodiment shown in FIG. 1 in a second position.
Figure 4:
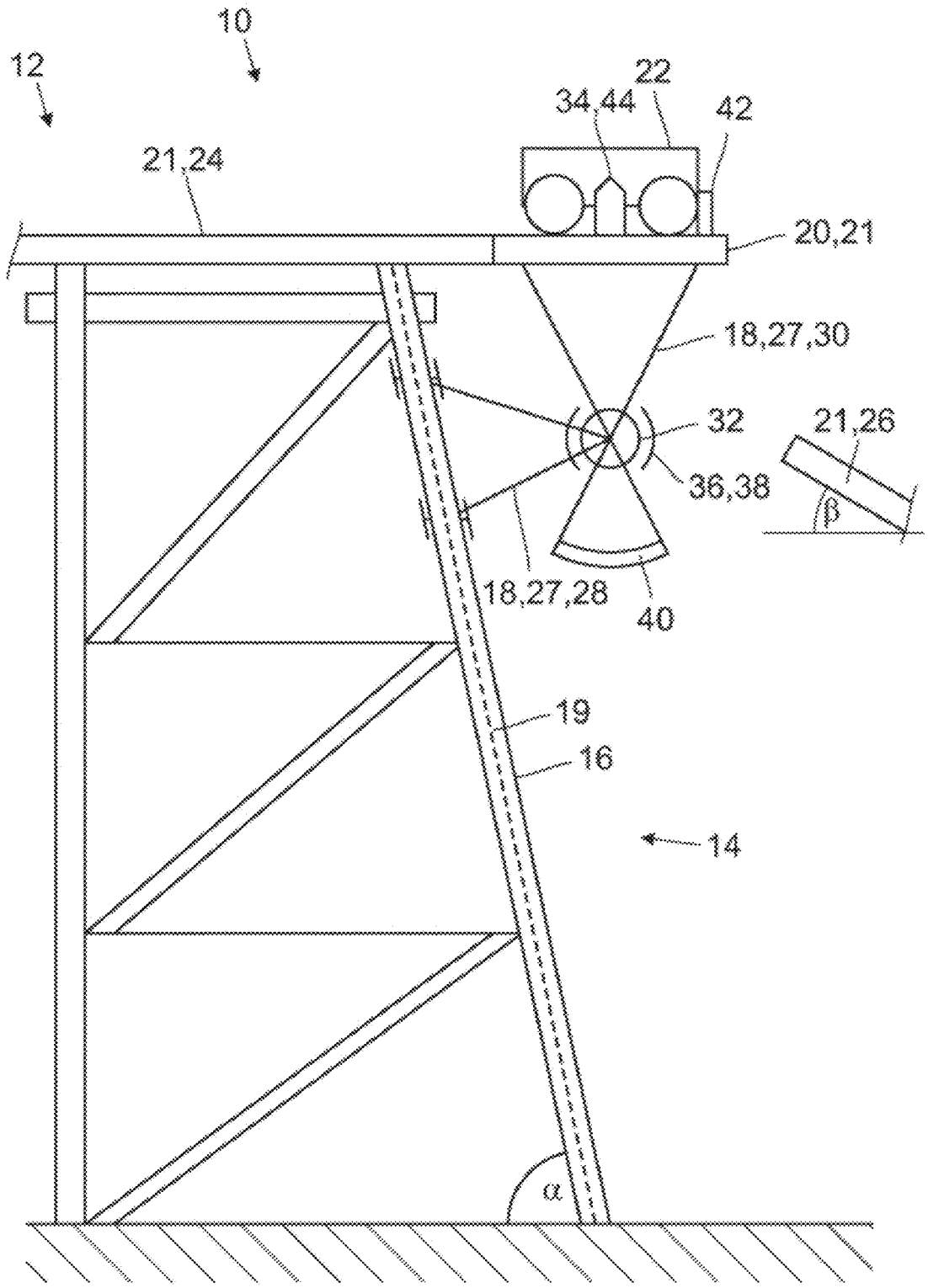
FIG. 4 shows another exemplary embodiment of the device according to the disclosure in a first position using a basic representation.

FIG. 4 shows another exemplary embodiment of the device 10 according to the disclosure, which differs from the exemplary embodiment shown in the FIGS. 1 to 3 in that the second guide track connection part 26 is inclined relative to the first guide track connection part 24. Whereas the first guide track connection part 24 runs horizontally, the second guide track connection part 26 is inclined relative to the horizontal by the angle β, which can be, for example, 30°. The angle β can be selected as desired and even exceed 90°.

LIST OF REFERENCE NUMERALS

10 device
12 guide structure
14 tower
16 guide rail
18 carrier structure
19 drive device
20 guide track section
21 guide track system
22 vehicle
24 first guide track connection part
26 second guide track connection part
27 means
28 first section
30 second section
32 other drive device
34 fixing device
36 limiting unit
38 stops
40 counterweight
44 wedge
ΔH difference in height
D1 first axis of rotation
D2 second axis of rotation

The invention claimed is:

1. A system, comprising:

a guide track section onto which a fair ride vehicle travels, a carrier structure for carrying the guide track section, a guide structure, which has an active connection with the carrier structure, wherein the active connection guides the carrier structure in such a manner that the guide track section moves translatory and back and forth between a first guide track connection part and a second guide track connection part along the guide structure, and a drive device that moves the carrier structure along the guide structure, wherein the carrier structure comprises means for making a back-and-forth movement or a rocking movement of the guide track section in addition to the translatory movement along the guide structure, and the back-and-forth movement or a rocking movement is independent to the translatory motion along the guide structure, wherein the guide track section moves between the first guide track connection part and the second guide track connection part that is arranged at a distance from the first guide track connection part, wherein the first guide track connection part and the second guide track connection part are arranged in a vertically offset with the first guide track connection part being higher than the second guide track connection part, whereby the fair ride vehicle together with the guide track section accelerate in free fall due to being exposed for a certain time to the fair ride vehicle weight without a delay or engaging a brake; and wherein the first guide track connection part and the second guide track connection part are part of the guide track system.

2. The system according to claim 1, wherein the means comprises a means first section connected to the guide structure and comprises a means second section connected to the guide track section, wherein the means second section moves relative to the means first section.

3. The system according to claim 2, further comprising a second drive device that moves the first section relative to the second section.

4. The system according claim 2, further comprising a limiting unit that movement of the guide track section.

5. The system according to claim 1, wherein the guide track section comprises a vehicle fixing device that secures the vehicle on the guide track section.

6. The system according to claim 1, wherein the drive device acts in such a manner on the carrier structure that movement along the guide structure is already made when the vehicle is still moving on the guide track section.

7. The system according to claim 1, wherein the first guide track connection part and the second guide track connection part are arranged in a vertically offset manner and the carrier structure is guided by the guide structure in such a manner along the guide structure that the guide track section moves back and forth from the first guide track connection part to the second guide track connection part that is vertically offset from the first guide track connection part.

8. The system according to claim 1, wherein the guide track connection parts are arranged inclined toward one another.

9. The system according to claim 1, wherein the guide structure is arranged inclined relative to vertical.

10. The system according to claim 1, wherein the guide structure is curved.

11. The system according to claim 1, wherein the guide track system is a rail system.

12. The system according to claim 1, wherein the guide structure is arranged on a tower or forms a tower itself.

13. A guide track system for vehicles of a fun fair ride, comprising a device according to claim 1.

14. A fun fair ride with a guide track system according to claim 13.

15. An amusement park ride system, comprising:

a track system on which an amusement park ride vehicle travels, the track system comprising a movable track section, a first track connection and a second track connection, wherein the first track connection and the second track connection are separated from each other, a guide structure;

a rotatable carrier coupled to the movable track section and coupled to the guide structure, wherein the guide structure guides the moveable track section back and forth between the first track connection and the second track connection, wherein the movable track section moves in translation along the guide structure, and wherein guiding the moveable track section back and forth between the first track connection and the second track connection is independent from the movable track section moving in translation along the guide structure;

a drive system that moves the carrier along the guide structure such that the movable track section moves between the first track connection part and the second track connection part; and wherein the first track connection and the second track connection are at different heights with the first track connection being higher than the second track connection, whereby the amusement park ride vehicle, together with the guide structure, free fall without engaging brakes.

16. The amusement park ride system according to claim 15, further comprising:

a carrier drive comprising a first support section coupled to the guide structure and a second support section coupled to the movable track section, wherein the first support section and the second support section are movable relative to each other, and wherein the carrier drive moves the first support section, the second support section or both the first support section and the second support section; and a stop that limits the movement of the first support section and the second support section relative to each other.

17. The amusement park ride system according to claim 15, further comprising:

wherein the first track connection is vertically offset from the second track connection; and wherein the first track connection is inclined relative to the second track connection.

18. The amusement park ride system according to claim 15, further comprising:

wherein movable track section is guided between the first track connection and the second track connection while the rotatable carrier is rotated.

19. An amusement park ride system, comprising:

a track system on which an amusement park ride vehicle travels, the track system comprising a movable track section, a first track connection and a second track connection, wherein the first track connection and the second track connection are separated from each other, wherein the first track connection is vertically offset from and higher than the second track connection, and wherein the first track connection is inclined relative to the second track connection;

a guide structure;

a rotatable carrier comprising a first support section coupled to the guide structure and a second support section coupled to the movable track section, wherein the first support section and the second support section are movable relative to each other, wherein the guide structure guides the moveable track section back and forth between the first track connection and the second track connection, and wherein the rotatable carrier rotates about a first axis and a second axis; and a drive system that moves the carrier along the guide structure such that the movable track section moves between the first track connection part and the second track connection part;

a carrier drive;

wherein the carrier drive moves the first support section, the second support section or both the first support section and the second support section; and wherein movable track section is guided between the first track connection and the second track connection while the rotatable carrier is rotated and the amusement park ride vehicle together with the movable track section accelerate in free fall for a certain time due the amusement park ride vehicle weight and without a delay or engaging a brake.

20. The amusement park ride system according to claim 19, wherein the amusement park ride vehicle travels along the movable track section while the movable track section is guided between the first track connection and the second track connection.

* * * * *